US011107411B1

(12) United States Patent
Zhang et al.

(10) Patent No.: US 11,107,411 B1
(45) Date of Patent: Aug. 31, 2021

(54) PIXEL DRIVING CIRCUIT,WITH TWO DISPLAY MODES DRIVING METHOD THEREOF, AND DISPLAY DEVICE

(71) Applicant: Shanghai Tianma AM-OLED Co., Ltd., Shanghai (CN)

(72) Inventors: Mengmeng Zhang, Shanghai (CN); Xingyao Zhou, Shanghai (CN); Yue Li, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 16/880,427

(22) Filed: May 21, 2020

(30) Foreign Application Priority Data

Mar. 25, 2020 (CN) ..... 202010216742.3

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2320/0626* (2013.01)

(58) Field of Classification Search
CPC .. G09G 3/3208; G09G 3/3225; G09G 3/3258; G09G 3/3266; G09G 2320/0626
See application file for complete search history.

(56) References Cited

U.S. PATENT DOCUMENTS 10,878,752 B1 * 12/2020 Li ..... G09G 3/325
2012/0139961 A1 * 6/2012 Choi ..... G09G 3/3208 345/690
2015/0356899 A1 * 12/2015 Yamanaka ..... G09G 3/3233 345/690
2016/0182901 A1 * 6/2016 Lee ..... H04N 13/398 345/691
2017/0162166 A1 * 6/2017 Kang ..... G09G 3/3696
2017/0186373 A1 * 6/2017 Nishikawa ..... G09G 3/3258
2017/0256200 A1 * 9/2017 Duan ..... G09G 3/3233
2018/0005570 A1 * 1/2018 Wang ..... G09G 3/3233
2018/0006097 A1 * 1/2018 Xiong ..... H01L 27/3248
2018/0033370 A1 * 2/2018 Zheng ..... G09G 3/3233
2018/0082651 A1 * 3/2018 Um ..... G09G 3/3614
(Continued)

FOREIGN PATENT DOCUMENTS

CN 104919517 A 9/2015
CN 106663403 A 5/2017
(Continued)

*Primary Examiner* — Kenneth Bukowski
(74) *Attorney, Agent, or Firm* — Anova Law Group, PLLC

(57) ABSTRACT

A pixel driving circuit includes a first power signal terminal, a second power signal terminal, a drive transistor, a light-emitting element, and a storage element. A gate of the drive transistor is connected to a first node, a first electrode of the drive transistor is connected to a second node, and a second electrode of the drive transistor is connected to a third node. A positive electrode of the light-emitting element is connected to a fourth node, and a negative electrode is connected to the second power signal terminal. A first terminal of the storage element is connected to a fixed potential, and a second terminal of the storage element is connected to the first node. In a same time frame of a display, a driving process using the pixel driving circuit includes a non-light-emitting phase and a light-emitting phase.

18 Claims, 9 Drawing Sheets

(56) References Cited

U.S. PATENT DOCUMENTS

| | | | | |
|---|---|---|---|---|
| 2018/0240430 | A1* | 8/2018 | Um | G09G 3/3614 |
| 2018/0293939 | A1* | 10/2018 | Kim | H01L 51/5203 |
| 2019/0051250 | A1* | 2/2019 | Lee | G09G 3/3266 |
| 2019/0180695 | A1* | 6/2019 | Ha | G09G 3/3266 |
| 2019/0340977 | A1* | 11/2019 | Park | G09G 3/2018 |
| 2020/0193916 | A1* | 6/2020 | Park | G09G 3/3258 |
| 2020/0226980 | A1* | 7/2020 | Park | G06F 1/3265 |
| 2020/0410939 | A1* | 12/2020 | Li | G09G 3/3275 |

FOREIGN PATENT DOCUMENTS

| | | | |
|---|---|---|---|
| CN | 109903725 | A | 6/2019 |
| WO | 2016201786 | A1 | 12/2016 |

* cited by examiner

200

PIXEL DRIVING CIRCUIT,WITH TWO DISPLAY MODES DRIVING METHOD THEREOF, AND DISPLAY DEVICE

CROSS-REFERENCE TO RELATED APPLICATION

This application claims priority to Chinese Patent Application No. 202010216742.3, filed on Mar. 25, 2020, the entire content of which is incorporated herein by reference.

TECHNICAL FIELD

The present disclosure relates to the display technology field and, more particularly, to a pixel driving circuit, a driving method thereof, and a display device.

BACKGROUND

An organic light-emitting display device has the advantages of self-light-emitting, low driving voltage, high luminous efficiency, fast response speed, light and thin, high contrast, etc. The organic light-emitting display device is the next-generation display device with the most development potential. The organic light-emitting display device is more and more widely applied in mobile phones, computers, televisions, in-vehicle display devices, wearable devices, and other display devices with display functions.

Pixels of the organic light-emitting display device include a pixel driving circuit. A drive transistor of the driving circuit can generate driving current. The light-emitting element emits light in response to the driving current. The driving current generated by the drive transistor is related to the potential of the gate of the drive transistor, and the gate of the drive transistor is connected to a storage capacitor.

Nowadays, the wearable devices include two display modes. One is a low-frequency display mode, and the other one is a normal frequency display mode. In the low-frequency display mode, the light-emitting element maintains the potential based on the storage capacitor. Within a frame time, leakage of the storage capacitor reduces the potential of the gate of the drive transistor. Then, brightness of the light-emitting element gradually increases and is higher than brightness in the normal frequency display mode. Therefore, when the devices switch the low-frequency display mode and the normal frequency display mode, the brightness of the light-emitting element can change abruptly, which affects the display performance of the display device.

The disclosed methods and systems are directed to solve one or more problems set forth above and other problems.

SUMMARY

Embodiments of the present disclosure provide a pixel driving circuit, including a first power signal terminal, a second power signal terminal, a drive transistor, a light-emitting element, and a storage element. A gate of the drive transistor is connected to a first node, a first electrode of the drive transistor is connected to a second node, and a second electrode of the drive transistor is connected to a third node. A positive electrode of the light-emitting element is connected to a fourth node, and a negative electrode is connected to the second power signal terminal. A first terminal of the storage element is connected to a fixed potential, and a second terminal of the storage element is connected to the first node. In a same time frame of a display, a driving process using the pixel driving circuit includes a non-light-emitting phase and a light-emitting phase. The pixel driving circuit includes a first-frequency-driving mode at a first frequency, and a second-frequency-driving mode at a second frequency, and the first frequency is higher than the second frequency. A signal received by the pixel driving circuit includes a first control signal. A pulse change amount of the first control signal from the non-light-emitting phase to the light-emitting phase in the first-frequency-driving mode is $\Delta V1$. A pulse change amount of the first control signal from the non-light-emitting phase to the light-emitting phase in the second-frequency-driving mode is $\Delta V2$. The pulse change amount $\Delta V2$ is larger than the pulse change amount $\Delta V1$.

Embodiments of the present disclosure provide a driving method of a pixel driving circuit, including a non-light-emitting phase and a light-emitting phase in a same time frame of a display, and a first-frequency-driving mode at a first frequency and a second-frequency-driving mode at a second frequency. The first frequency is higher than the second frequency. A pulse change amount of a first control signal from the non-light-emitting phase to the light-emitting phase in the first-frequency-driving mode is $\Delta V1$. A pulse change amount of the first control signal from the non-light-emitting phase to the light-emitting phase in the second-frequency-driving mode is $\Delta V2$. The pulse change amount $\Delta V2$ is greater than the pulse change amount $\Delta V1$.

Embodiments of the present disclosure provide a display device, including a pixel driving circuit. The pixel driving circuit includes a first power signal terminal, a second power signal terminal, a drive transistor, a light-emitting element, and a storage element. A gate of the drive transistor is connected to a first node, a first electrode of the drive transistor is connected to a second node, and a second electrode of the drive transistor is connected to a third node. A positive electrode of the light-emitting element is connected to a fourth node, and a negative electrode is connected to the second power signal terminal. A first terminal of the storage element is connected to a fixed potential, and a second terminal of the storage element is connected to the first node. In a same time frame of a display, a driving process using the pixel driving circuit includes a non-light-emitting phase and a light-emitting phase. The pixel driving circuit includes a first-frequency-driving mode at a first frequency, and a second-frequency-driving mode at a second frequency, and the first frequency is higher than the second frequency. A signal received by the pixel driving circuit includes a first control signal. A pulse change amount of the first control signal from the non-light-emitting phase to the light-emitting phase in the first-frequency-driving mode is $\Delta V1$. A pulse change amount of the first control signal from the non-light-emitting phase to the light-emitting phase in the second-frequency-driving mode is $\Delta V2$. The pulse change amount $\Delta V2$ is larger than the pulse change amount $\Delta V1$.

Other aspects of the present disclosure can be understood by those skilled in the art in light of the description, the claims, and the drawings of the present disclosure.

DETAILED DESCRIPTION

Figure 1:
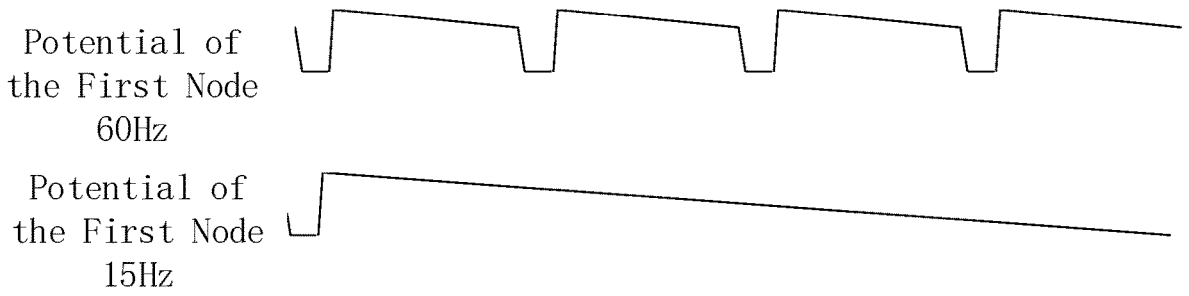
FIG. 1 (Prior art)
FIG. 1 illustrates a comparison diagram of a gate potential of a drive transistor in two different frequency display modes.

Various exemplary embodiments of the present disclosure are described in detail with reference to the accompanying drawings. Unless otherwise specified, relative arrangements, numeral expressions, and numeral values of components and processes described in these embodiments do not limit the scope of the present disclosure.

The following description of at least one exemplary embodiment is merely illustrative and does not limit the present disclosure and its application or use. Techniques, methods, and equipment known to those of ordinary skill in the art may not be discussed in detail, but where appropriate, the techniques, methods, and equipment should be considered as a part of the specification.

In all examples shown and discussed here, any specific values should be interpreted as merely exemplary and not limiting. Other examples of the exemplary embodiments may have different values. Similar reference numerals and letters may indicate similar items in the following accompanying drawings. Once an item is defined in one drawing, the item does not need to be discussed further in the subsequent drawings.

Figure 2:
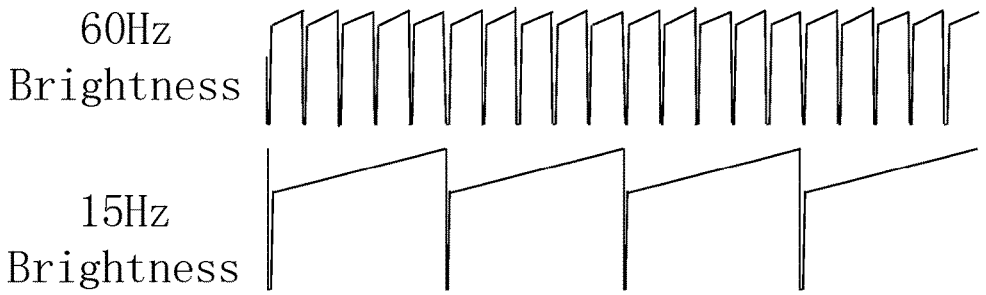
FIG. 2 (Prior art)
FIG. 2 illustrates a comparison diagram of brightness of a light-emitting element in two different frequency display modes.

Nowadays, wearable products generally use a low-frequency display in an idle mode. By taking an example of a frequency of 60 Hz as a normal frequency and a frequency of 15 Hz as a low display frequency, when a display frequency is 15 Hz, a pixel relies on a storage capacitor to maintain a potential of a gate of a drive transistor. Within a frame time of a display, leakage of the storage capacitor reduces the potential of the gate of the drive transistor. Then, brightness of a light-emitting element often gradually increases. FIG. 1 illustrates a comparison diagram of a gate potential of a drive transistor in two different frequency display modes in the existing technology. FIG. 2 illustrates a comparison diagram of the brightness of a light-emitting element in two different frequency display modes in the existing technology. As shown in FIG. 1 and FIG. 2, in a 60 Hz display mode, the highest potential of the drive transistor is maintained well, and the brightness is more uniform. In a 15 Hz display mode, the gate potential of the drive transistor is maintained poorly, and the brightness increases. The brightest of the 15 Hz display mode is brighter than the brightness of the 60 Hz display mode. Therefore, when the product switches the two frequency display modes, the brightness of the display device changes suddenly. A sudden change of the brightness of display affects display performance of the display device.

Therefore, the present disclosure provides a pixel driving circuit, a driving method thereof, and a display device to address at least the above technical issues. When a product switches a first-frequency-driving mode and a second-frequency-driving mode, the provided pixel driving circuit, a driving method, and a display device can reduce the sudden change of the brightness of the display device, and improve the display performance of the display device.

Figure 3:
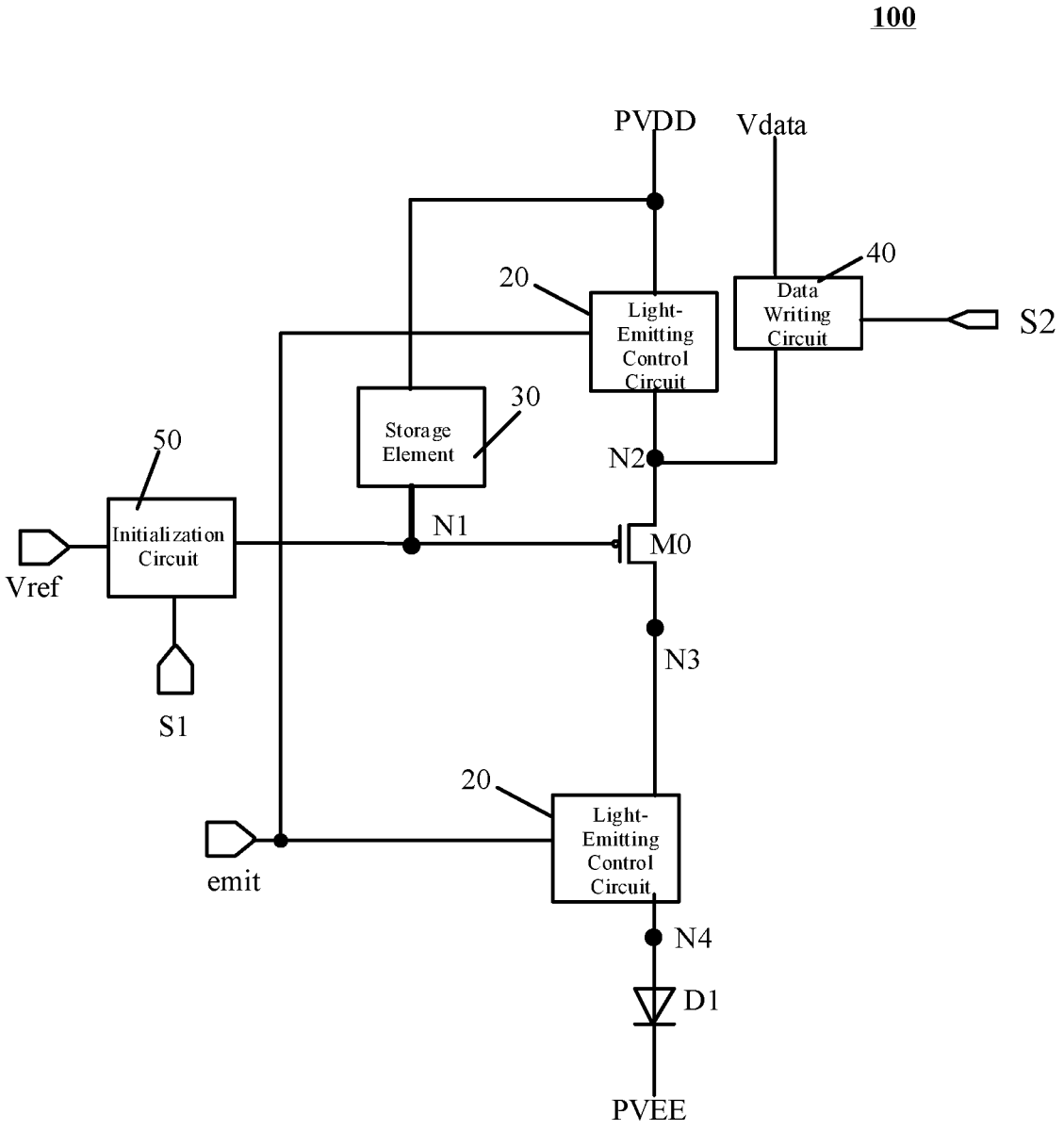
FIG. 3 illustrates a schematic diagram of a structure of a pixel driving circuit according to embodiments of the present disclosure.

FIG. 3 illustrates a schematic diagram of a structure of a pixel driving circuit according to embodiments of the present disclosure. As shown in FIG. 3, a pixel driving circuit 100 includes a first power signal terminal PVDD and a second power signal terminal PVEE, a drive transistor M0, a light-emitting element D1, a light-emitting control circuit 20, and a memory circuit 30. A gate of the drive transistor M0 is connected to the first node N1. A first electrode of the drive transistor M0 is connected to a second node N2. The second electrode of the drive transistor M0 is connected to a third node N3. A positive electrode of the light-emitting element D1 is connected to a fourth node N4. A negative electrode is connected to the second power signal terminal PVEE.

The light-emitting control circuit 20, the drive transistor M0, and the light-emitting element D1 are connected in series between the first power signal terminal PVDD and the second power signal terminal PVEE. The first terminal of the memory circuit 30 is connected to a fixed potential. The second terminal of the memory circuit 30 is connected to the first node N1. Optionally, the first terminal of the storage element 30 may be connected to the first power signal terminal PVDD.

In a same time frame of displaying, a displaying process controlled by the pixel driving circuit 100 includes a non-light-emitting phase and a light-emitting phase. The pixel driving circuit 100 includes the first-frequency-driving mode at a first frequency and the second-frequency-driving mode at a second frequency, where the first frequency is higher than the second frequency. A signal received by the pixel driving circuit 100 includes a first control signal. In the first-frequency-driving mode, from the non-light-emitting stage to the light-emitting stage, a pulse change (i.e., difference between a high-level voltage value and a low-level voltage value of the first control signal) amount of the first control signal is $\Delta V1$. In the second-frequency-driving mode, and from the lighting phase to the lighting phase, the pulse change amount of the first control signal is $\Delta V2$, wherein $\Delta V2 > \Delta V1$.

FIG. 3 shows a framework of the pixel driving circuit 100 in the present disclosure. In other embodiments, the pixel driving circuit 100 may also include other frameworks, which is not limited by the present disclosure.

Referring to FIG. 3, the pixel circuit 100 includes the non-light-emitting phase and the light-emitting phase. In the non-light-emission phase, the pixel driving circuit 100 performs preparations before light-emitting. For example, the non-lighting phase may include an initialization phase, and the pixel driving circuit 100 includes an initialization circuit 50. A control terminal of the initialization circuit 50 is connected to a control signal terminal S1. A first terminal of the initialization circuit 50 is connected to an initialization signal terminal Vref. A second terminal of the initialization circuit 50 is connected to the first node N1. In the initialization phase, the control signal terminal S1 controls the initialization circuit 50 to turn on. The initialization signal terminal Vref transmits an initialized signal to the first node N1 to turn on the drive transistor M0. In other embodiments, the non-lighting emitting phase may also include a data writing stage.

The pixel driving circuit 100 may also include a writing circuit 40. The control terminal of the writing circuit 40 is connected to a control signal terminal S2. A first terminal of the writing circuit 40 is connected to a data signal terminal Vdata. A second terminal of the writing circuit 40 is connected to the first node N2. In the data writing phase, the control signal terminal S2 controls the writing circuit 40 to turn on. The data signal terminal Vdata transmits a data signal to the second node N2. Although the initialization phase and the data writing phase are used to illustrate the non-light-emitting phase, it is not intended to limit the non-light-emitting phase. In the lighting phase, the lighting control circuit 20 is turned on. The driving current of the drive transistor M0 is transmitted to the light-emitting element D1 to cause the light-emitting element D1 to emit light.

Further, the pixel driving circuit 100 includes a first-frequency-driving mode at a first frequency and a second-frequency-driving mode at a second frequency, where the first frequency is higher than the second frequency. The signals received by the pixel driving circuit 100 include a first control signal. From the non-lighting emitting phase to the lighting phase, a pulse of the first control signal changes. In the pixel driving circuit 100, in the first-frequency-driving mode with a higher frequency, and from the non-light-emission stage to the light-emission stage, the corresponding pulse change amount of the first control signal is ΔV1. In the second-frequency-driving mode with a lower frequency, from the non-light-emission stage to the light-emission stage, the corresponding pulse change amount of the first control signal is ΔV2.

In one embodiment, the relationship between the pulse change amounts may be set as ΔV2>ΔV1, that is, the pulse change amount of the first control signal corresponding to the second frequency (lower frequency) driving mode is greater than the amount of pulse change of first control signal corresponding to the first frequency (higher frequency) driving mode. The pulse change amount here refers to a voltage value of the first control signal corresponding to the light-emitting phase minus a voltage value of the first control signal corresponding to the non-light-emitting phase in the first-frequency-driving mode or the second-frequency-driving mode. For example, in the first-frequency-driving mode, the voltage of the first control signal of the non-light-emitting phase is 7V. The voltage of the first control signal of the light-emitting phase change to −6V. Therefore, the pulse change amount is (−6V)−7V, which is −13V. In the second-frequency-driving mode, the voltage of the first control signal of the non-light-emitting phase is 6V. The voltage of the first control signal of the light-emitting phase is −6V. Therefore, the pulse change amount is (−6V)−6V, which is −12V. The pulse change amount (−12V) of the first control signal in the second-frequency-driving mode is greater than the pulse change amount (−13V) of the first control signal in the first-frequency-driving mode.

Further, a coupling capacitance exists between the first control signal and the first node N1. If the first control signal changes from high-level to low-level, from the non-light-emission stage to the light-emission stage, the potential of the first node N1 decreases. Since ΔV2>ΔV1, compared to the first-frequency-driving mode, a decreased amount in the potential of the first node N1 in the second-frequency-driving mode decreases, and a coupling amount of the first node N1 decreases. Therefore, compared to the first-frequency-driving mode, the potential of the first node N1 in the second-frequency-driving mode can be increased. If the first control signal changes from low-level to high-level, from the non-light-emission stage to the light-emission stage, the potential of the first node N1 increases. Since ΔV2>ΔV1, compared to the first-frequency-driving mode, an increased amount of the potential of the first node N1 in the second-frequency-driving mode increases, and the coupling amount of the first node N1 increases. Therefore, compared to the first-frequency-driving mode, the potential of the first node N1 in the second-frequency-driving mode can further be increased.

As ΔV2>ΔV1, compared to the first-frequency-driving mode, which makes the potential of the first node N1 connected to the gate of the drive transistor M0 in the second-frequency-driving mode to increase. As such, the potential increase offsets the increase of the brightness of the light-emitting element D1 due to the decrease in the potential of the first node N1 in the low-frequency driving mode, which is beneficial to reduce a brightness difference of the light-emitting element D1 in the first-frequency-driving mode and the second-frequency-driving mode. Furthermore, the possibility of a sudden change of the brightness of the display device is reduced when the product switches between the first-frequency-driving mode and the second-frequency-driving mode. Therefore, the brightness transition effect of the display device is improved when the product switches the two driving modes, and the display performance of the display device is further improved.

In some embodiments, the first frequency is f1, and the second frequency is f2, where 30 Hz<f1<90 Hz, and f2≤30 Hz.

In some embodiments, the first frequency with a higher frequency in the present disclosure is selected to be higher than 30 Hz and less than 90 Hz. In a normal display when the first frequency is used for driving, the display device operates 31 to 89 times in one second. The refresh frequency is high, and the image display is consistent, which is beneficial to improve the display performance of the display device. When the second frequency with a lower frequency in the present disclosure is selected to be less than or equal to 30 Hz. That is, in a standby mode, the product uses a lower frequency for display, such as a watch of the wearable devices. When only time needs to be displayed, the second frequency with lower frequency can be used for display. At this moment, a number of operations in one second is smaller, and corresponding power consumption is lower, which is beneficial to save the power consumption of the display device. The present disclosure uses two different frequency driving modes, which are suitable for different display requirements and, At the same time, are beneficial to save the power consumption of a display panel.

Figure 4:
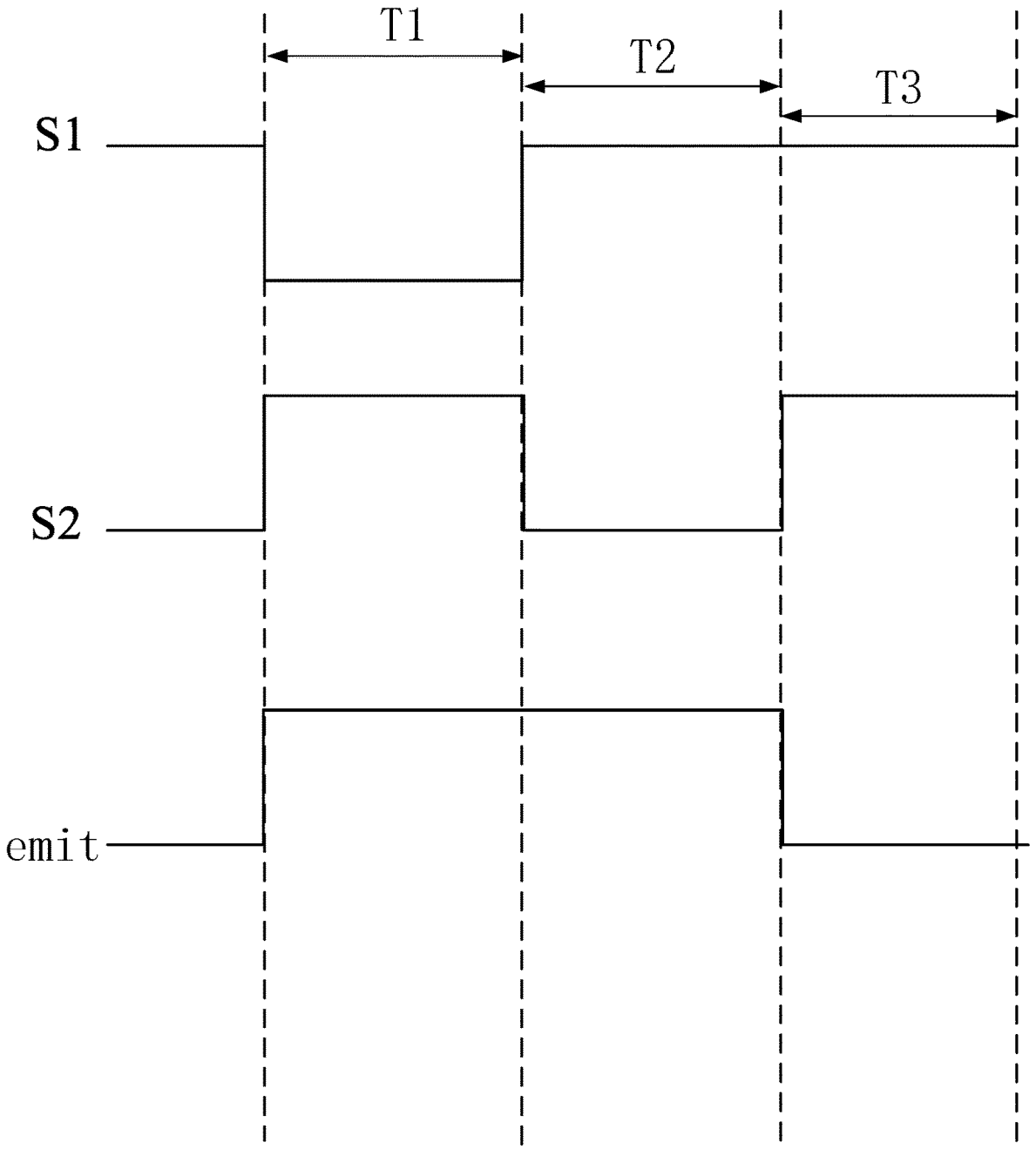
FIG. 4 illustrates a driving timing diagram of the pixel circuit according to embodiments of the present disclosure.

The pulse change during the operation of the pixel driving circuit in the present disclosure is described below in connection with a timing diagram. FIG. 4 illustrates a driving timing diagram of the pixel circuit according to embodiments of the present disclosure. T1 represents an initialization phase. T2 represents a data writing phase. T3 represents a light-emitting phase, and emit represents a signal of a light-emitting control signal terminal emit. The initialization phase T1 and the data writing phase T2 are the non-light-emitting phases. The data writing phase T2 is adjacent to the light-emitting phase T3. From the data writing phase T2 to the light-emitting phase T3, the light-emitting control signal terminal emit changes from high-level to low-level.

In some embodiments, referring to FIG. 3, the light-emitting control circuit 20 is connected to the light-emitting control terminal emit via a light-emitting control line. In the light-emitting phase, the light-emitting control terminal emit receives the light-emitting control signal. The light-emitting terminal transmits the light-emitting signal to the light-emitting control circuit 20 by the light-emitting control line, where the light-emitting signal is used as the first control signal.

In the first-frequency-driving mode, the light-emitting control signal includes a first level signal and a second level signal. A level signal may refer to a voltage level signal here. Although the voltage level signal is defined as the level signal here, other types of signals such as a current level signal may also be defined as the level signal. The first level signal has a voltage value VGH1. The second level signal has a voltage value VGL1. VGH1>VGL1, and ΔV1=VGL1−VGH1.

In the second-frequency-driving mode, the light-emitting control signal includes a third level signal and a fourth level signal. A voltage value of the third level signal is VGH2. A voltage value of the fourth level signal is VGL2. VGH2>VGL2, and ΔV2=VGL2−VGH2.

In some embodiments, referring to FIG. 3, in the non-light-emitting phase, the light-emitting signal received by the light-emitting control circuit 20 is the first level signal (corresponding to the high-level signal of emit in FIG. 4). At the moment, the light-emitting control circuit 20 is off. In the light-emitting phase, the light-emitting signal received by the light-emitting control circuit 20 is the second level signal (corresponding to the low-level signal of emit in FIG. 4). At the moment, the light-emitting control circuit 20 is on. In the first-frequency-driving mode, from the non-light-emitting phase to the light-emitting phase, the light-emitting control signal jumps from the first level signal to the second level signal. From the non-light-emitting phase to the light-emitting phase, the voltage changes from VGH1 to VGL1, that is, changes from high-level to low-level. Therefore, the voltage change amount is ΔV1=VGL1-VGH1. In the second-frequency-driving mode, from the non-light-emitting phase to the light-emitting phase, the light-emitting control signal jumps from the third level signal to the fourth level signal. From the non-light-emitting phase to the light-emitting phase, the voltage changes from VGH2 to VGL2 that is, changes from high-level to low-level. Therefore, the voltage change amount is ΔV2=VGL2−VGH2. Table 1 shows a comparison table of voltage change amounts in the first-frequency-driving mode and the second-frequency-driving mode. As shown in Table. 1, in the first frequency mode, VGH1=8V, VGL1=−7V, and the voltage change amount is ΔV1=−15V. In the second frequency mode, VGH2=7V, VGL2=−7V, and the voltage change amount is ΔV2=−14V, where ΔV2>ΔV1. Table 1 only shows one specific value of an embodiment. Table 1 cannot limit the actual voltage value of the light-emitting control signal.

TABLE 1

A comparison table of voltage change amount in the first-frequency-driving mode and the second-frequency-driving mode

| Voltage | Voltage corresponding to the first frequency/V | Voltage corresponding to the second frequency/V |
|---|---|---|
| VGH | 8 | 7 |
| VGL | −7 | −7 |
| Voltage change amount VGL-VGH | −15 | −14 |

When the light-emitting control signal is considered as the first control signal in the present disclosure, from the non-light-emitting phase to the light-emitting phase, the light-emitting control signal changes from high-level to low-level. Due to a parasitic capacitance between the light-emitting control line and the first node N1, when the light-emitting control signal changes from high-level to low-level, the potential of the first node N1 is lowered. Since ΔV2>ΔV1, that is VGL2−VGH2>VGL1-VGH1, comparing the second-frequency-driving mode to the first-frequency-driving mode, in the second-frequency-driving mode the decreased amount of the first node N1 is decreased, that is, the coupling amount of the first node N1 is reduced.

Thus, compared with the first-frequency-driving mode, the potential of the first node N1 is increased in the second-frequency-driving mode. That is, compared to the first-frequency-driving mode, the second-frequency-driving mode is beneficial to increase the potential of the first node N1 connected to the gate of the drive transistor M0, which offsets the increase of the brightness of the light-emitting element D1 due to the decrease of the potential of the first node N1 in the low-frequency driving mode. Therefore, the brightness difference of the light-emitting element D1 is reduced in the first-frequency-driving mode and the second-frequency-driving mode. Furthermore, the possibility of the sudden change of the brightness of the display device is reduced when the product switches between the first-frequency-driving mode and the second-frequency-driving mode.

In some embodiments, VGL2>VGL1, and/or, VGH2<VGH1.

Figure 5:
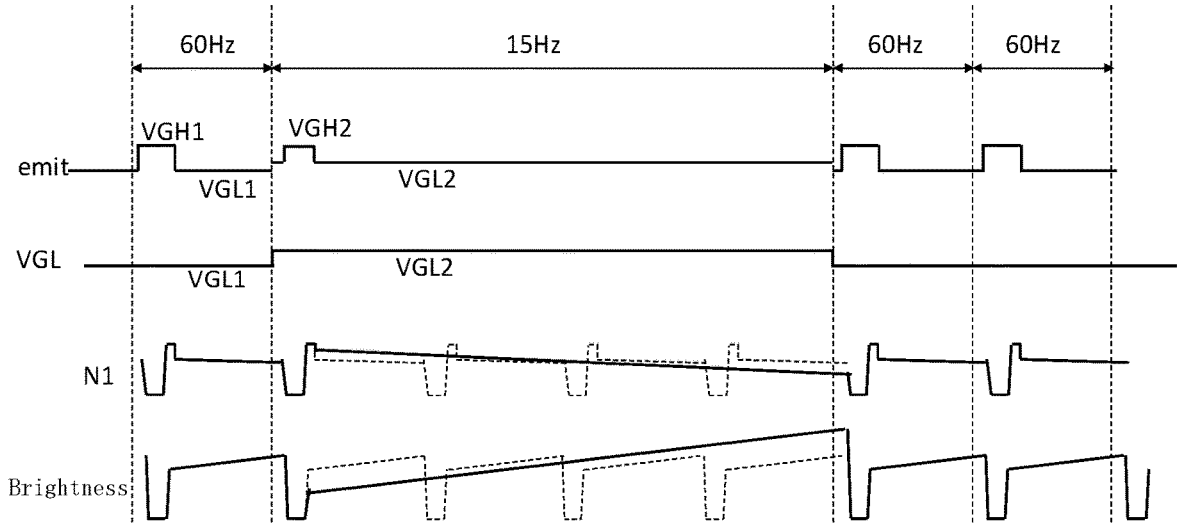
FIG. 5 illustrates a comparison schematic diagram of the potential and brightness of a first node when VGL2 is increased in the two frequency driving modes.

In some embodiments, VGL2 can be increased to achieve VGL2−VGH2>VGL1-VGH1 in the second-frequency-driving mode. FIG. 5 illustrates a comparison schematic diagram of the potential and brightness of a first node when VGL2 is increased in the two frequency driving modes. FIG. 5 takes an example that the first frequency is 60 Hz, and the second frequency is 15 Hz for description. In a potential change curve of the first node N1, to compare the potentials of the first node N1 at 15 Hz and 60 Hz, the change of the potential of the first node N1 at 60 Hz is indicated by a dotted line in the potential change curve of the first node N1 corresponding to 15 Hz. Similarly, in the brightness change curve, to compare the brightness of the light-emitting element D1 at 15 Hz and 60 Hz, the brightness change of the light-emitting element D1 at 60 Hz is indicated by a dotted line in the brightness change curve corresponding to 15 Hz.

Referring to FIG. 5, in the second-frequency-driving mode (corresponding to 15 Hz), when VGL2>VGL1 is set, from the non-lighting phase to the light-emitting phase, a jump between VGH2 and VGL2 is reduced, and the coupling amount of the first node N1 is decreased. Compared to the first-frequency-driving mode, the potential of the first node N1 is increased in the second-frequency-driving mode.

The brightness difference of the light-emitting element D1 is decreased in the first-frequency-driving mode and the second-frequency-driving mode, which offsets the increase of the brightness of the light-emitting element D1 due to the decrease of the potential of the first node N1 in the lower frequency driving mode. Therefore, it is beneficial to reduce the brightness difference of the light-emitting element D1 in the first-frequency-driving mode and the second-frequency-driving mode. Furthermore, the possibility of a sudden change of the brightness of the display device is reduced when the product switches between the first-frequency-driving mode and the second-frequency-driving mode.

Figure 6:
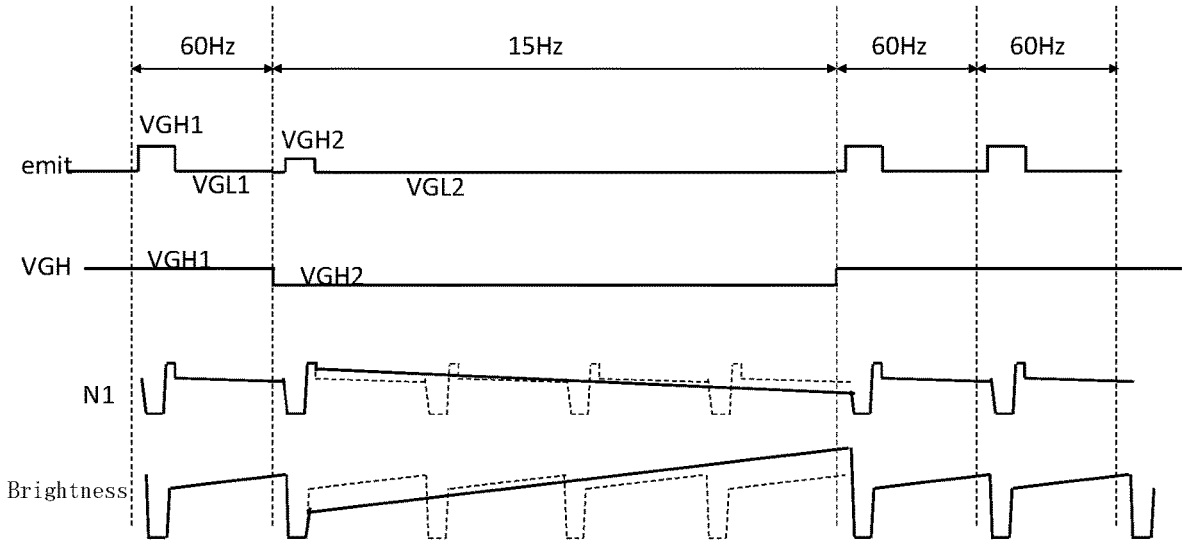
FIG. 6 illustrates a comparison schematic diagram of the potential and brightness of the first node when VGH2 is decreased in the two frequency driving modes.

In some embodiments, the VGH2 in the second-frequency-driving mode can also be decreased to achieve VGL2−VGH2>VGL1−VGH1. FIG. 6 illustrates a comparison schematic diagram of the potential and brightness of the first node when VGH2 is decreased in the two frequency driving modes. FIG. 6 takes an example that the first frequency is 60 Hz, and the second frequency is 15 Hz for description. In a potential change curve of the first node N1, to compare the potentials of the first node N1 at 15 Hz and 60 Hz, the change of the potential of the first node N1 at 60 Hz is indicated by a dotted line in the potential change curve of the first node N1 corresponding to 15 Hz. Similarly, in the brightness change curve, to compare the brightness of the light-emitting element D1 at 15 Hz and 60 Hz, the brightness change of the light-emitting element D1 at 60 Hz is indicated by a dotted line in the brightness change curve corresponding to 15 Hz.

Referring to FIG. 6, in the second-frequency-driving mode (corresponding to 15 Hz), when VGH2>VGH1 (e.g., in Table 1, VGH2 is 7V, and VGH1 is 8V) is set, from the non-lighting phase to the light-emitting phase, a jump between VGH2 and VGL2 is reduced, and the coupling amount of the first node N1 is decreased. Compared to the first-frequency-driving mode, the potential of the first node N1 is increased in the second-frequency-driving mode. The brightness difference of the light-emitting element D1 is decreased in the first-frequency-driving mode and the second-frequency-driving mode, which offsets the increase of the brightness of the light-emitting element D1 due to the decrease of the potential of the first node N1 in the lower frequency driving mode. Therefore, it is beneficial to reduce the brightness difference of the light-emitting element D1 in the first-frequency-driving mode and the second-frequency-driving mode. Furthermore, the possibility of the sudden change of the brightness of the display device is reduced when the product switches between the first-frequency-driving mode and the second-frequency-driving mode.

FIG. 5 only increases VGL2 as an example for description. FIG. 6 and Table. 1 only decreases VGH2 as an example for description. In other embodiments, VGH2 is increased while VGL2 is decreased to achieve the purpose of increasing the potential of the first node N1 in the second-frequency-driving mode.

The present disclosure is described by taking an example that the light-emitting control circuit 20 is turned off under high-level control and turned on under low-level control. In some other embodiments, the light-emitting control circuit 20 can also be turned off under low-level control and turned on under high-level control, which is not limited by the present disclosure.

In some embodiments, in the second-frequency-driving mode, when the VGL2 is increased to increase the potential of the first node N1, the VGL1<VGL2≤1.3*VGL1. That is, compared to the voltage value VGL1 corresponding to the second level signal in the first-frequency-driving mode, the voltage value VGL2 corresponding to the fourth level signal in the second-frequency-driving mode is appropriately increased. As such, the first node N1 potential is not excessively increased, and the potential difference of the first node N1 in the two frequency driving modes is not too large. Thus, the brightness does not dim in the second-frequency-driving mode. Controlling the increase of VGL2 within 30% is also beneficial to avoid that the voltage drop is too large due to the excessive-high gate voltage of the transistor of the light-emitting control circuit, which in turn leads to excessive power consumption and a new impact on the light-emitting brightness.

In some embodiments, in the second-frequency-driving mode, when the VGH2 is decreased to increase the potential of the first node N1, 0.7*VGH1≤VGH2≤VGH1. That is, compared to the voltage value VGH1 corresponding to the first level signal in the first-frequency-driving mode, the voltage value VGH2 corresponding to the third level signal in the second-frequency-driving mode is appropriately increased. As such, the first node N1 potential is not excessively increased, and the potential difference of the first node N1 in the two frequency driving modes is not too large. Thus, the brightness does not dim in the second-frequency-driving mode. In addition, when VGH2 is too low, leakage may occur and the light-emitting element may emit light undesirably.

Figure 7:
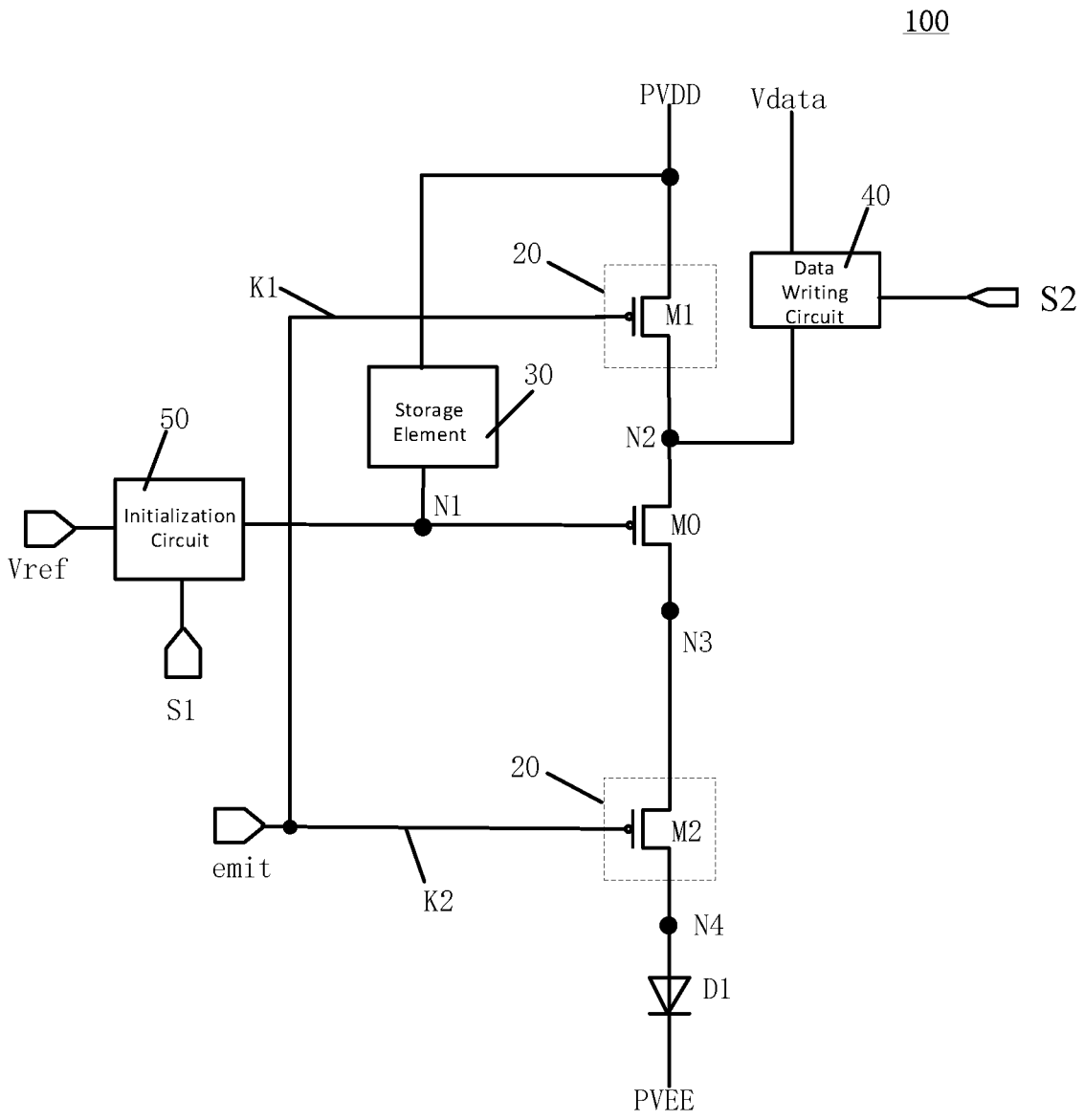
FIG. 7 illustrates another schematic frame structural diagram of the pixel driving circuit according to embodiments of the present disclosure.

In some embodiments, FIG. 7 illustrates another schematic frame structural diagram of the pixel driving circuit 100 according to embodiments of the present disclosure. The light-emitting control circuit 20 includes a first transistor M1 and a second transistor M2. The light-emitting control lines include a first light-emitting control line K1 and a second light-emitting control line K2. The gate of the first transistor M1 is connected to the light-emitting control terminal through the first light-emitting control line K1, and the gate of the second transistor M2 is connected to the light-emitting control terminal through the second light-emitting control line K2.

The first electrode of the first transistor M1 is connected to the first power signal terminal PVDD. The second electrode of the first transistor M1 is connected to the second node N2. The first electrode of the second transistor M2 is connected to the third node N3. The second electrode of the second transistor M2 is connected to the fourth node N4.

For example, the first transistor M1 and the second transistor M2 are both P-type transistors for description purposes. In some other embodiments, the first transistor M1 and the second transistor M2 can also be N-type transistors. P-type transistor is turned on at low-level and turned off at high-level, and N-type transistor is turned on at high-level and turned off at low-level. When the types of the first transistor M1 and the second transistor M2 are the same, they can be connected to the same light-emitting control terminal emit through the light-emitting control lines, which is beneficial to reduce the number of signal terminals in a driving chip of the display device to save production cost of the chip.

In some embodiments, in the light-emitting phase, the light-emitting control terminal inputs a low-level control signal to the gates of the first transistor M1 and the second transistor M2. The first transistor M1 and the second transistor M2 are turned on. The signal of the first power signal terminal PCDD is transmitted from the first transistor M1 to the second node N2. The drive transistor M0 forms driving current. The driving current is transmitted to the positive electrode of the organic light-emitting element D1 through the second transistor M2. The organic light-emitting element D1 emits light according to the driving current. Thus, the display device achieves the display function.

Referring to FIG. 4, from the data writing phase T2 to the light-emitting phase T3, a scan signal transmitted from the control signal terminal S2 changes from low-level to high-level.

Figure 8:
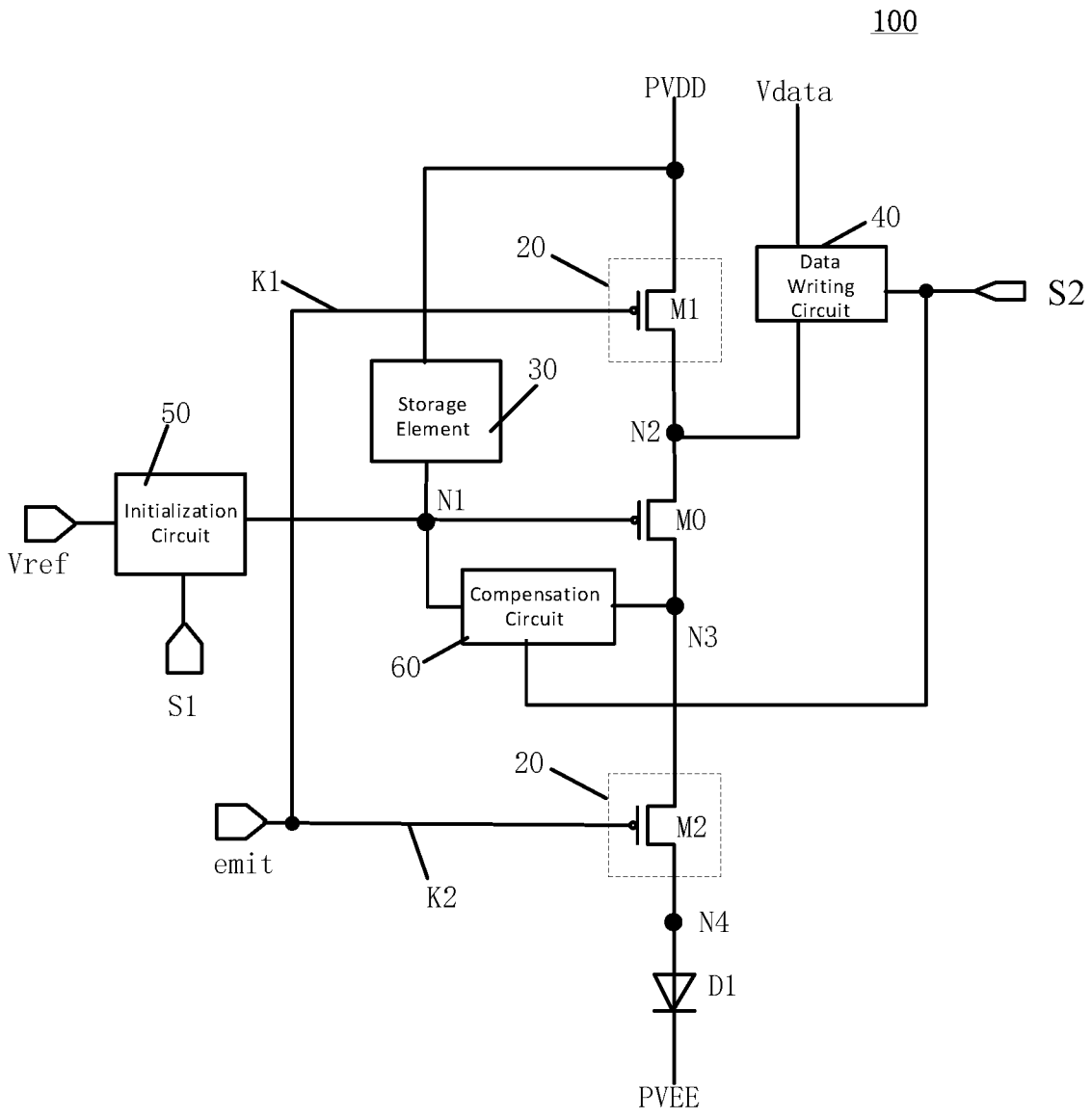
FIG. 8 illustrates another schematic frame structural diagram of the pixel driving circuit according to embodiments of the present disclosure.

In some embodiments, FIG. 8 illustrates another schematic frame structural diagram of the pixel driving circuit according to embodiments of the present disclosure. Referring to FIG. 8, the pixel driving circuit 100 also includes a compensation circuit 60. A first terminal of the compensation circuit 60 is connected to the first node N1. The second terminal of the compensation circuit 60 is connected to the third node N3. The control terminal is connected to the control signal terminal S2. The control signal terminal S2 is used for transmitting the scan signal to the compensation circuit 60. The scan signal is used as the first control signal.

In the first-frequency-driving mode, the scan signals include a first scan signal and a second scan signal. The voltage value of the first scan signal is VH1, and the voltage value of the second scan signal is VL1. VH1>VL1, and ΔV1=VH1−VL1.

In the second-frequency-driving mode, the scan signals include a third scan signal and a fourth scan signal. The voltage value of the third scan signal is VH2, and the voltage value of the fourth scan signal is VL2. VH2>VL2, and ΔV2=VH2−VL2.

In some embodiments, the scan signal transmitted to the compensation circuit 60 is used as the first control signal, which is taken as an example for further description. Referring to FIG. 8, the present disclosure introduces the compensation circuit 60 in the pixel driving circuit 100, and at the same time, the pixel driving circuit further includes a data writing circuit 40. The data writing circuit 40 is connected to the data signal terminal Vdata. The non-light-emitting phase of the pixel driving circuit 100 includes a data writing phase. During the data writing phase, the data writing circuit 40 communicates with the compensation circuit 60. The signal of the data signal terminal Vdata is transmitted to the second node N2. The signal of the second node N2 is transmitted to the third node N3 through the drive transistor M0. The signal of the third node N3 is transmitted to the first node N1 through the compensation circuit 60. During the light-emitting phase, the data writing circuit 40 and the compensation circuit 60 are turned off. The voltage signal changes when the compensation circuit 60 is turned off from on.

In the first-frequency-driving mode with a higher frequency, the compensation circuit 60 is turned on when receiving the second scan signal, and is turned off when receiving the first scan signal. The voltage value of the scan signal changes from VL1 to VH1 from on to off. That is, the voltage changes from low-level to high-level. Therefore, a voltage change amount is ΔV1=VH1−VL1.

In the second-frequency-driving mode with a lower frequency, the compensation circuit 60 is turned on when receiving the fourth scan signal, and is turned off when receiving the third scan signal. The voltage value of the scan signal changes from VL2 to VH2 from on to off. That is, the voltage changes from low-level to high-level. Therefore, a voltage change amount is ΔV2=VH2−VL2. Table 2 illustrates another comparison table of the voltage change amount in the first-frequency-driving mode and the second-frequency-driving mode. As shown in table 2, VH1=7V, and VL1=−6V, in the first-frequency-driving mode, the voltage change amount is ΔV1=13V. In the second-frequency-driving mode, VH2=8V, and VL2=−7V, the voltage change amount is ΔV2=15V, where Δ V2>ΔV1. Table 2 only uses a specific value as an example, and does not limit the actual voltage value of the scan signal.

TABLE 2

The voltage change amount comparison table in two frequency driving modes

| Voltage | Voltage corresponding to the first frequency/V | Voltage corresponding to the second frequency/V |
|---|---|---|
| VH | 7 | 8 |
| VL | −6 | −7 |
| Voltage change amount VH-VL | 13 | 15 |

When the scan signal is used as the first control signal in the present disclosure, from the non-light-emitting phase to the light-emitting phase, the scan signal changes from low-level to high-level. Since a parasitic capacitance exists between the scan line and the first node N1, when the scan signal of the scan line changes from low-level to high-level, which is equivalent to raising the potential of the first node N1. Since ΔV2>ΔV1, e.g., VH2−VL2>VH1−VL1, compared to the first-frequency-driving mode, in the second-frequency-driving mode, a raising amount of the first node N1 is increased, that is, a coupling amount of the first node N1 is increased. As such, compared to the first-frequency-driving mode, in the second-frequency-driving mode, the potential of the first node N1 can be increased more greatly. That is, compared to the first-frequency-driving mode, in the second-frequency-driving mode, the potential of the first node N1 connected to the gate of the drive transistor M0 is increased, which offsets the increase of the brightness of the light-emitting element D1 caused by the decrease of the potential of the first node N1 in the low-frequency driving mode. As such, the brightness difference of the light-emitting element D1 in the first-frequency-driving mode and the second-frequency-driving mode is reduced. Furthermore, the possibility of the sudden change of the brightness of the display device is reduced when the product switches between the first-frequency-driving mode and the second-frequency-driving mode.

In some embodiments, VL2<VL1 and/or VH2>VH1.

Figure 9:
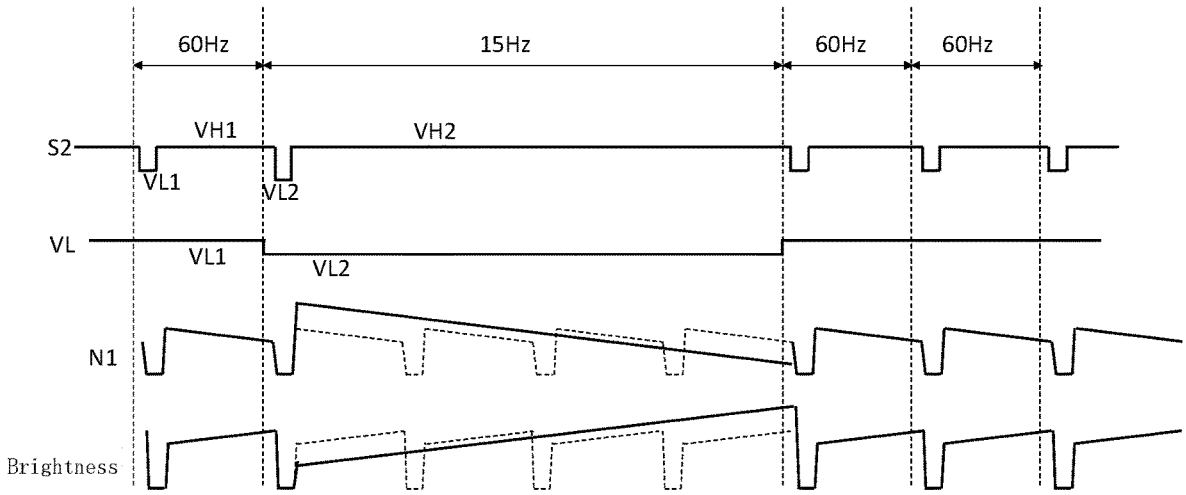
FIG. 9 illustrates a comparison schematic diagram of the potential and brightness of the first node when VL2 is decreased in the two frequency driving modes.

In some embodiments, to realize VH2−VL2>VH1−VL1, the VL2 may be reduced in the second-frequency-driving mode. FIG. 9 illustrates a comparison schematic diagram of the potential and brightness of the first node N1 when VL2 is decreased in the two frequency driving modes. In FIG. 9, the first frequency is 60 Hz, and the second frequency is 15 Hz, which are used as an example for further description. In the first node N1 potential change curve, to compare the first node N1 potential at 15 Hz and 60 Hz, in the change curve of the first node N1 potential corresponding to 15 Hz, the change of the potential of the first node N1 at 60 Hz is indicated by a dotted line. In the brightness change curve, to compare the brightness of the light-emitting element D1 at 15 Hz and 60 Hz, in the change curve of the brightness corresponding to 15 Hz, the change of the brightness of the light-emitting element D1 at 60 Hz is indicated by a dotted line.

As shown in FIG. 9, in the second-frequency-driving mode (corresponding to 15 Hz), by setting VL2<VL1, from the non-light-emitting phase to the light-emitting phase, a jump between VL2 and VH2 becomes larger, the coupling amount of the first node N1 is increased, the potential of the first node N1 is increased, and the brightness difference of the light-emitting element D1 is reduced in the first-frequency-driving mode and the second-frequency-driving mode. As such, the increase of the potential of the first node N1 is beneficial to offset the brightness increase due to the decrease of the first node N1 potential in the lower frequency driving mode. Furthermore, the possibility of a sudden change of the brightness of the display device is reduced when the product switches between the first-frequency-driving mode and the second-frequency-driving mode.

Figure 10:
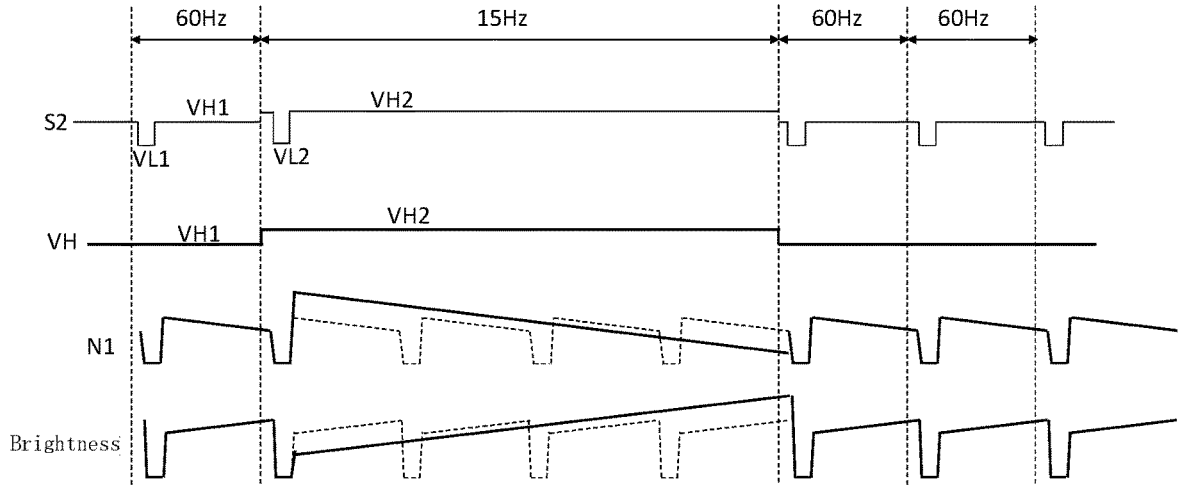
FIG. 10 illustrates a comparison schematic diagram of the potential and brightness of the first node when VH2 is increased in the two frequency driving modes.

In some embodiments, to realize VH2−VL2>VH1−VL1, the VH2 may be increased in the second-frequency-driving mode. FIG. 10 illustrates a comparison schematic diagram of the potential and brightness of the first node N1 when VH2 is increased in the two frequency driving modes. In FIG. 9, the first frequency is 60 Hz, and the second frequency is 15 Hz, which are used as an example for further description. In the first node N1 potential change curve, to compare the first node N1 potential at 15 Hz and 60 Hz, in the change curve of the first node N1 potential corresponding to 15 Hz, the change of the first node N1 potential at 60 Hz is indicated by a dotted line. In the brightness change curve, to compare the brightness of the light-emitting element D1 at 15 Hz and 60 Hz, in the change curve of the brightness corresponding to 15 Hz, the change of the brightness of the light-emitting element D1 at 60 Hz is indicated by a dotted line.

As shown in FIG. 10, in the second-frequency-driving mode (corresponding to 15 Hz), by setting VH2>VH1, from the non-light-emitting phase to the light-emitting phase, a jump between VL2 and VH2 becomes larger, the coupling amount of the first node N1 increases, the first node N1 potential is increased, and the brightness difference of the light-emitting element D1 is reduced in the first-frequency-driving mode and the second-frequency-driving mode. As such, the increase of the potential of the first node N1 is beneficial to offset the brightness increase due to the decrease of the first node N1 potential in the lower frequency driving mode. Furthermore, the possibility of the sudden change of the brightness of the display device is reduced when the product switches between the first-frequency-driving mode and the second-frequency-driving mode.

In FIG. 9, only VL2 is reduced, which is used as an example for description. In FIG. 10, only VH2 is increased, which is used as an example for description. In some other embodiments, VL2 is reduced, while VH2 is increased (e.g., the data provided in table 2). As such, the potential of the first node N1 is increased in the second-frequency-driving mode.

The compensation circuit 60 is turned off under high-level control and turned on under a low-level control, which is taken as an example for description in the present disclosure. In some other embodiments, the compensation circuit 60 may be turned on under high-level control and turned off under low-level control, which is not limited by the present disclosure.

In some embodiments, in the second-frequency-driving mode, when the first node N1 potential is increased by reducing VL2, 0.8*VL1≤VL2<VL1. That is, compared to the voltage value VL1 corresponding to the second scan signal in the first-frequency-driving mode, the voltage value VGL2 corresponding to the fourth scan signal is properly reduced in the second-frequency-driving mode, and the reduction amount is controlled within 20%. As such, the first node N1 potential is not excessively increased, and the potential difference of the first node N1 in the two frequency driving modes is not too large. Thus, the brightness does not dim in the second-frequency-driving mode. Therefore, an over-compensation is avoided due to a larger difference in the display brightness in the first-frequency-driving mode and the second-frequency-driving mode.

In some embodiments, in the second-frequency-driving mode, when the first node N1 potential is increased by increasing VH2, VH1<VH2≤1.2*VH1. That is, compared to the voltage value VH1 corresponding to the first scan signal in the first-frequency-driving mode, the voltage value VH2 corresponding to the third scan signal is appropriately increased in the second-frequency-driving mode, and the increased amount is controlled within 20%. As such, the first node N1 potential is not excessively increased, and the potential difference of the first node N1 in the two frequency driving modes is not too large. Thus, the brightness does not dim in the second-frequency-driving mode. Therefore, an over-compensation is avoided due to a larger difference in the display brightness in the first-frequency-driving mode and the second-frequency-driving mode. An excessive increase of VH2 can cause the excessive power consumption, which is not beneficial to save power consumption.

Figure 11:
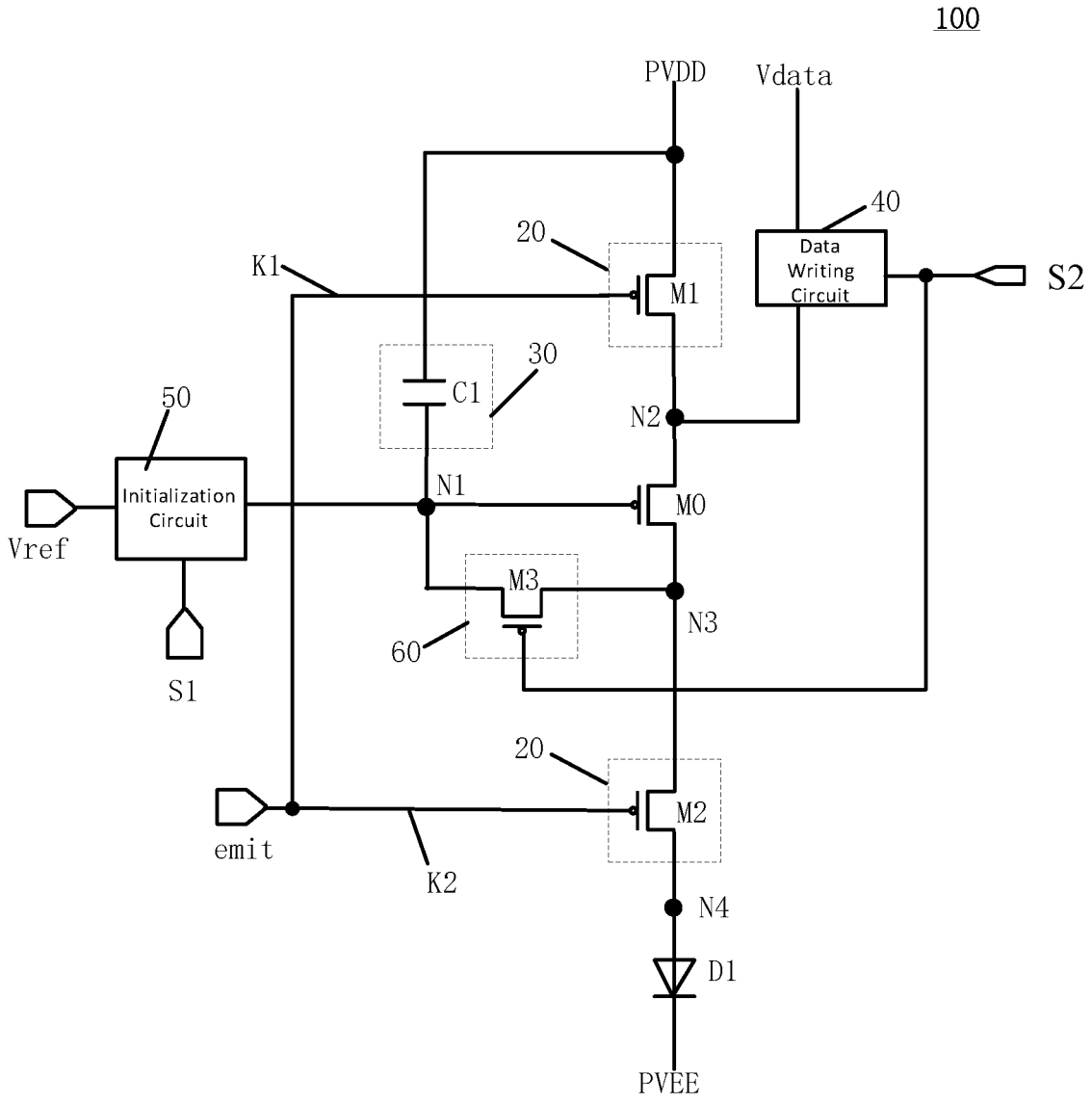
FIG. 11 illustrates a schematic diagram of another structure of a pixel driving circuit according to embodiments of the present disclosure.

In some embodiments, FIG. 11 illustrates a schematic diagram of another structure of a pixel driving circuit 100 according to embodiments of the present disclosure. The compensation circuit 60 includes a compensation transistor M3. A first electrode of the compensation transistor M3 is used as the first terminal of the compensation circuit 60, and a second electrode of the compensation transistor M3 is used as the second terminal of the compensation circuit 60. A gate of the compensation transistor M3 is used as the control terminal of the compensation circuit 60. The storage element 30 is a storage capacitor C1.

The present embodiment is described by taking the compensation transistor M3 as a P-type transistor as an example. In some other embodiments, the compensation transistor M3 may be an N-type transistor. The P-type transistor is turned on under low-level and turned off under high-level. The N-type transistor is turned off under low-level and turned on under high-level. In the present embodiment, the gate of the compensation transistor M3 and the gate of the data writing circuit 40 are connected to the same control signal terminal and receive the same scan signal, which is beneficial to save the number of the control signal terminals in the pixel driving circuit 100 and simplify the pixel circuit design.

Accordingly, the present disclosure further provides a driving method of the pixel driving circuit 100 described in the above embodiments. Referring to FIG. 3, in the same time frame, the driving method of the pixel driving circuit 100 includes the non-light-emitting phase and the light-emitting phase. The driving method of the pixel driving circuit 100 includes the first-frequency-driving mode at the first frequency and the second-frequency-driving mode at the second frequency. The first frequency is higher than the second frequency.

In the first-frequency-driving mode, from the non-light-emitting phase to the light-emitting phase, a pulse change of the first control signal is ΔV1. In the second-frequency-driving mode, from the non-light-emitting phase to the light-emitting phase, a pulse change of the first control signal is ΔV2, ΔV2>ΔV1.

In some embodiments, the pixel driving circuit includes the first-frequency-driving mode at the first frequency and the second-frequency-driving mode at the second frequency. The first frequency is higher than the second frequency. The signal received by the pixel driving circuit includes the first control signal. From the non-light-emitting phase to the light-emitting phase, a pulse change of the first control signal changes. In the driving method of the pixel driving circuit, in the first-frequency-driving mode with the higher frequency, from the non-light-emitting phase to the light-emitting phase, a corresponding pulse change amount of the first control signal is ΔV1. In the second-frequency-driving mode with a lower frequency, from the non-light-emitting phase to the light-emitting phase, a corresponding pulse change amount of the first control signal is ΔV2. The present disclosure sets ΔV2>ΔV1, that is, the pulse change amount of the first control signal corresponding to the second frequency (lower frequency) driving mode is greater than the pulse change amount of the first control signal corresponding to the first frequency (higher frequency) driving mode. The pulse change amount means, in the first-frequency-driving mode/second-frequency-driving mode, the difference between the voltage value of the first control signal in the light-emitting phase and the voltage value of the first control signal in the non-light-emitting phase. For example, in the first-frequency-driving mode, the voltage value of the first control signal in the non-light-emitting phase is 7V, and the voltage value of the first control signal in the light-emitting phase changes to −6V, thus the pulse change amount is (−6)V−7V, i.e., −13V. In the second-frequency-driving mode, the voltage value of the first control signal in the non-light-emitting phase is 6V, and the voltage value of the first control signal in the light-emitting phase is −6V, thus the pulse change amount is (−6)V−6V, i.e., −12V. Therefore, the pulse change amount (−12V) of the first control signal in the second-frequency-driving mode is greater than the pulse change amount (−13V) of the first control signal in the first-frequency-driving mode.

By considering a coupling capacitance existing between the first control signal and the first node N1, assuming that, from the non-light-emitting phase to the light-emitting phase, the first control signal changes from high-level to low-level, and the potential of the first node N1 is decreased. Since ΔV2>ΔV1, compared to the first-frequency-driving mode, the decrease of first node N1 potential is reduced in the second-frequency-driving mode, and the coupling amount of the first node N1 is reduced. As such, compared to the first-frequency-driving mode, the first node N1 potential is increased in the second-frequency-driving mode. Assuming that, from the non-light-emitting phase to the light-emitting phase, the first control signal changes from low-level to high-level, and the first node N1 potential is increased. Since ΔV2>ΔV1, compared to the first-frequency-driving mode, the increase of the first node N1 potential is increased in the second-frequency-driving mode, and the coupling amount of the first node N1 is increased. As such, compared to the first-frequency-driving mode, the first node N1 potential is further increased in the second-frequency-driving mode. Therefore, the present disclosure sets ΔV2>ΔV1, compared to the first-frequency-driving mode, the potential of the first node N1 connected to the gate of the drive transistor M0 is increased in the second-frequency-driving mode, which offsets the increase of the brightness of the light-emitting element D1 due to the decrease of the potential of the first node N1 in the low-frequency driving mode. As such, the brightness difference of the light-emitting element D1 is reduced in the first-frequency-driving mode and the second-frequency-driving mode. When switching between the first-frequency-driving mode and the second-frequency-driving mode, the possibility of the sudden change in the brightness of the display is reduced, which is beneficial to improve the brightness transition effect of the display when the two driving modes are switched, and further to improve the display effect of the display.

In some embodiments, as shown in FIG. 3, the light-emitting control circuit 20 is connected to the light-emitting control terminal via the light-emitting control line. The light-emitting control terminal receives the light-emitting control signal and transmits the light-emitting control signal to the light-emitting circuit 20 via the light-emitting control line. The light-emitting control signal is used as the first control signal.

In the first-frequency-driving mode, the light-emitting control signal includes a first level signal and a second level signal. In the non-light-emitting phase, the light-emitting control terminal transmits the first level signal to the light-emitting control circuit 20, and controls the light-emitting control circuit 20 to turn off. A voltage value corresponding to the first level signal is VGH1. In the light-emitting phase, the light-emitting control terminal transmits the second level signal to the light-emitting control circuit 20 to turn on the light-emitting control circuit 20. A voltage value corresponding to the second level signal is VGL1, where ΔV1=VGL1−VGH1.

In the second-frequency-driving mode, the light-emitting control signal includes a third level signal and a fourth level signal. In the non-light-emitting phase, the light-emitting control terminal transmits the third level signal to the light-emitting control circuit 20 to turn off the light-emitting control circuit 20. A voltage value corresponding to the third level signal is VGH2. In the light-emitting phase, the light-emitting control terminal transmits the fourth level signal to the light-emitting control circuit 20 to turn on the light-emitting control circuit 20. A voltage value corresponding to the fourth level signal is VGL2, where ΔV2=VGL2−VGH2.

As shown in FIG. 3, in some embodiments, the driving method of the pixel driving circuit 100 is described by taking the light-emitting control signal as the first control signal as an example.

In the non-light-emitting phase, the light-emitting control signal received by the light-emitting control circuit 20 is used as the first level signal (the emitted high-level signal in FIG. 4). The light-emitting control circuit 20 is off. In the light-emitting phase, the light-emitting control signal received by the light-emitting control circuit 20 is used as the second level signal (the emitted low-level signal in FIG. 4). The light-emitting control circuit 20 is on. In the first-frequency-driving mode, from the non-light-emitting phase to the light-emitting phase, the light-emitting control signal jumps from the first level signal to the second level signal, and the voltage changes from VGH1 to VGL1, that is, changes from high-level to low-level. Therefore, the voltage change amount is ΔV1=VGL1−VGH1. In the second-frequency-driving mode, from the non-light-emitting phase to the light-emitting phase, the light-emitting control signal jumps from the third level signal to the fourth level signal, and the voltage changes from VGH2 to VGL2, that is, changes from high-level to low-level. Therefore, the change amount is ΔV2=VGL2−VGH2.

When the light-emitting control signal is used as the first control signal, from the non-light-emitting phase to the light-emitting phase, the light-emitting control signal changes from high-level to low-level. Since the parasitic capacitance exists between the light-emitting control line and the first node N1, when the light-emitting control signal changes from high-level to low-level, the potential of the first node N1 is lowered. Since ΔV2>ΔV1, that is VGL2−VGH2>VGL1-VGH1, comparing the second-frequency-driving mode to the first-frequency-driving mode, the decrease of the potential of the first node N1 is reduced in the second-frequency-driving mode, and the coupling amount of the first node N1 is reduced. As such, compared to the first-frequency-driving mode, the potential of the first node N1 is increased in the second-frequency-driving mode. That is, compared to the first-frequency-driving mode, the potential of the first node N1 connected to the gate of the drive transistor M0 is beneficially increased in the second-frequency-driving mode, which offsets the brightness increase of the light-emitting element D1 due to the decrease of the potential of the first node N1 in the low-frequency driving mode. Thus, the brightness difference of the light-emitting element D1 is beneficially reduced in the first-frequency-driving mode and the second-frequency-driving mode. Furthermore, the possibility of the sudden change in the brightness of the display is reduced when the driving mode switches between the first-frequency-driving mode and the second-frequency-driving mode.

To realize VGL2−VGH2>VGL1-VGH1, VGL2 may be increased in the second-frequency-driving mode, or VGH2 is decreased in the second-frequency-driving mode.

In some embodiments, as shown in FIG. 4 and FIG. 8, the pixel driving circuit 100 includes the compensation circuit 60. The first terminal of the compensation circuit 60 is connected to the first node N1, the second terminal is connected to the third node N3, and the control terminal is connected to the control signal terminal. The control signal terminal is configured to transmit the scan signal to the compensation circuit 60. The scan signal is used as the first control signal. The non-light-emitting phase includes the data writing phase.

In the first-frequency-driving mode, the scan signal includes the first scan signal and the second scan signal. In the data writing phase, the first control signal terminal transmits the second scan signal to the compensation circuit 60 to turn on the compensation circuit 60. The voltage value corresponding to the second scan signal is VL1. In the light-emitting phase, the first control signal terminal transmits the first scan signal to the compensation circuit 60 to turn off the compensation circuit 60. The voltage value corresponding to the first scan signal is VH1. When the compensation circuit 60 is from on to off, the voltage value of the scan signal changes from VL1 to VH1, that is, changes from low-level to high-level, therefore, ΔV1=VH1−VL1.

In the second-frequency-driving mode, the scan signal includes the third scan signal and the fourth scan signal. In the data writing phase, the first control signal terminal transmits the fourth signal to the compensation circuit 60 to turn on the compensation circuit 60. The voltage value of the fourth scan signal is VL2. In the light-emitting phase, the first control signal terminal transmits the third scan signal to the compensation circuit 60 to turn off the compensation circuit 60. The voltage value of the third scan signal is VH2. When the compensation circuit 60 is from on to off, the voltage value of the scan signal changes from VL2 to VH2, that is, changes from low-level to high-level, therefore, ΔV2=VH2−VL2.

As shown in FIG. 4 and FIG. 8, the driving method of the pixel driving circuit 100 is described by taking the scan signal received by the compensation circuit 60 as the first control signal as an example.

In the light-emitting phase, the data writing circuit 40 and the compensation circuit 60 are off. When the compensation circuit 60 is from on to off, the voltage signal of the compensation circuit 60 changes. In the first-frequency-driving mode with the higher frequency, the compensation circuit 60 is turned on when receiving the second scan signal, and is turned off when receiving the first scan signal. From on to off, the voltage value of the scan signal changes from VL1 to VH1, that is, changes from low-level to high-level, therefore, the voltage change amount is ΔV1=VH1−VL1. In the second-frequency-driving mode with a lower frequency, the compensation circuit 60 is turned on when receiving the fourth scan signal and is turned off when receiving the third scan signal. From on to off, the voltage value of the scan signal changes from VL2 to VH2, that is, changes from low-level to high-level, therefore, the voltage change amount is ΔV2=VH2−VL2.

When the scan signal is used as the first control signal, from the non-light-emitting phase to the light-emitting phase, the scan signal changes from low-level to high-level. Since the parasitic capacitance exists between the scan line and the first node, and when the scan signal at the scan line changes from low-level to high-level, the potential of the first node N1 is increased. Since ΔV2>ΔV1, that is VH2−VL2>VH1−VL1, by comparing the second-frequency-driving mode to the first-frequency-driving mode, the increased amount of the first node N1 is increased in the second-frequency-driving mode, that is, the coupling amount of the first node N1 is increased. As such, compared to the first-frequency-driving mode, the potential of the first node N1 is more greatly increased in the second-frequency-driving mode. That is, compared to the first-frequency-driving mode, the potential of the first node N1 connected to the gate of the drive transistor M0 is beneficially increased in the second-frequency-driving mode, which offsets the brightness increase of the light-emitting element D1 due to the decrease of the potential of the first node N1 in the low-frequency driving mode. Thus, the brightness difference of the light-emitting element D1 is reduced in the first-frequency-driving mode and the second-frequency-driving mode. Therefore, the possibility of the sudden change of the brightness of the display is reduced when the driving mode switches between the first-frequency-driving mode and the second-frequency-driving mode.

To realize VH29−VL2>VH1−VL1, VL2 may be decreased in the second-frequency-driving mode, or VH2 is increased in the second-frequency-driving mode.

An operation process of the pixel driving circuit 100 is described by taking the first-frequency-driving mode as an example. As shown in FIG. 4 and FIG. 11, FIG. 4 illustrates a driving timing diagram of the pixel circuit 100 structural diagram according to embodiments of the present disclosure.

In the initialization phase T1, the control signal terminal S1 transmits a low-level signal to the initialization circuit 50 to turn on the initialization circuit 50. The initialization signal terminal Vref transmits the initialization signal to the first node N1 to turn on the drive transistor M0.

In the data writing phase T2, the initialization circuit 50 is off. The control signal terminal S2 transmits a low-level signal to the data writing circuit 40 to turn on the data writing circuit 40 and the compensation circuit 60. The data signal terminal Vdata transmits the data signal to the second node N2. The signal of the second node N2 is transmitted to the third node N3 through the drive transistor M0. The signal of the third node N3 is transmitted to the first node N1 through the compensation circuit 60.

In the light-emitting phase T3, the data writing circuit 40 and the compensation circuit 60 are off. The light-emitting control terminal emit transmits a low-level signal to the light-emitting control circuit 20 to turn on the light-emitting control circuit. As such, the drive transistor M0 is connected to the light-emitting element D1. The drive current of the drive transistor M0 is transmitted to the light-emitting element D1 to cause the light-emitting element D1 to emit light.

Figure 12:
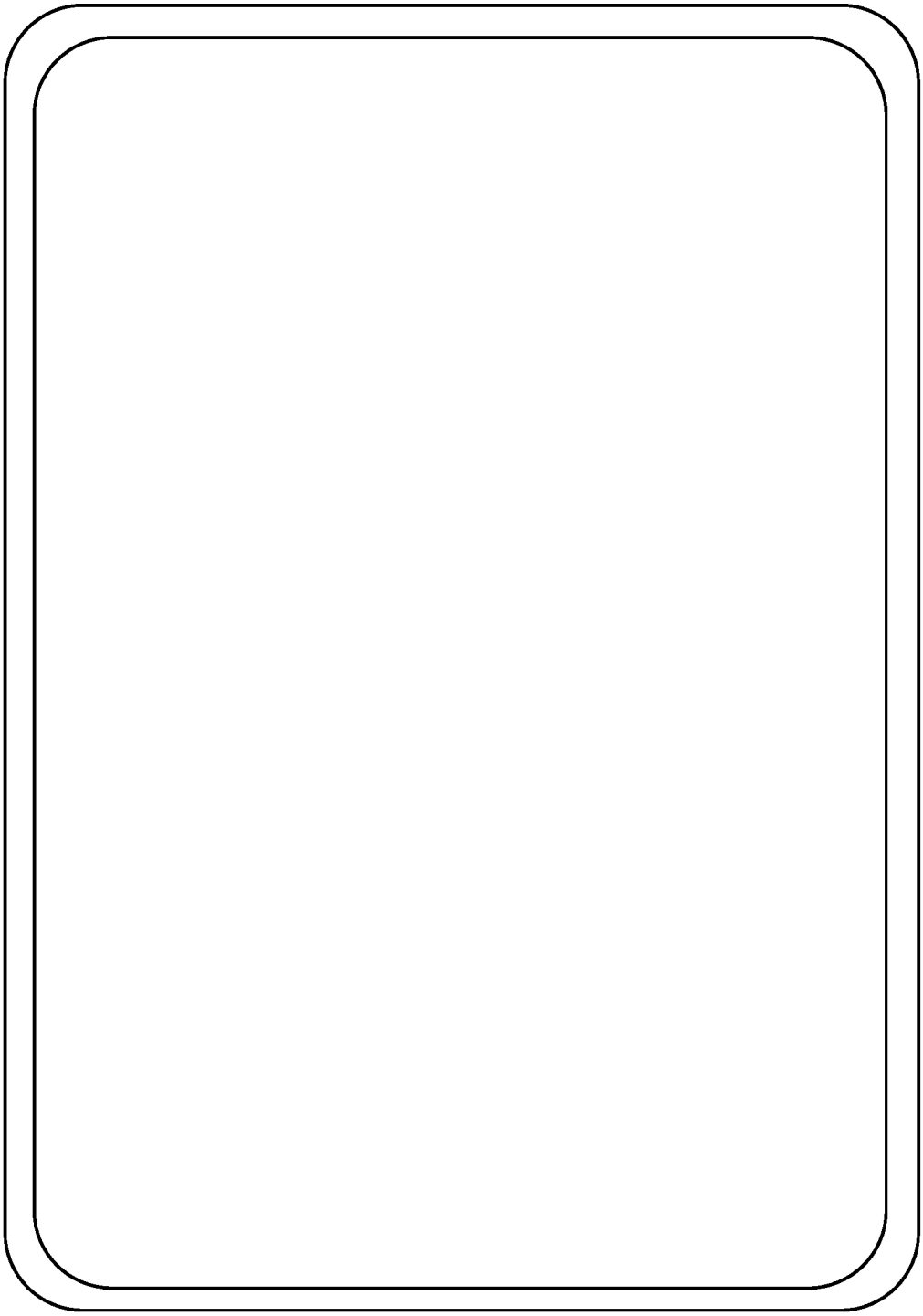
FIG. 12 illustrates a schematic diagram of a display device according to embodiments of the present disclosure.

Based on the same idea, the present disclosure further provides a display device. FIG. 12 illustrates a schematic diagram of a display device according to embodiments of the present disclosure. The display device 200 includes the pixel driving circuit provided by any embodiment of the present disclosure described above. When the display device includes the pixel driving circuit provided by the embodiments described above, the possibility of the sudden change of the brightness of the display device is beneficially reduced when the driving mode switches between the first-frequency-driving mode and the second-frequency-driving mode. Thus, the brightness transition effect of the display device is improved when the two driving modes switch to each other to improve the display effect of the display device.

Embodiments of the display device 200 may be referred to the embodiments of the display panel 100 described above, which are not repeated here. The display device may include any product or component having realistic functions, such as a cell phone, a tablet, a TV, a monitor, a notebook computer, a digital photo frame, a GPS, etc.

The display device is especially suitable for electronic display products with low-frequency display requirements such as wearable devices, such as a watch with a display screen, etc.

The pixel driving circuit, driving method thereof, and display device at least implement the following beneficial effects.

In the pixel driving circuit, the driving method thereof, and the display device, the pixel driving circuit operates under the control of various control signals. The pixel driving circuit includes the first-frequency-driving mode at the first frequency and the second-frequency-driving mode at the second frequency. The first frequency is higher than the second frequency. The signal received by the pixel driving circuit includes the first control signal. From the non-light-emitting phase to the light-emitting phase, the pulse of the first control signal changes. In the present disclosure, in the first-frequency-driving mode with the higher frequency, from the non-light-emitting phase to the light-emitting phase, the pulse change amount corresponding to the first control signal is $\Delta V1$. In the second-frequency-driving mode with the lower frequency, from the non-light-emitting phase to the light-emitting phase, the pulse change amount corresponding to the first control signal is $\Delta V2$. The present disclosure sets $\Delta V2>\Delta V1$, that is, the pulse change amount of the first control signal corresponding to the second frequency (lower frequency) driving mode is greater than the pulse change amount of the first control signal corresponding to the first frequency (higher frequency) driving mode, which is beneficial to increase the potential of the first node N1 connected to the gate of the drive transistor. As such, the increase of the potential of the first node offsets the increase of the brightness due to the decrease of the potential of the first node in the lower frequency driving mode, which is beneficial to reduce the brightness difference of the light-emitting element in the first-frequency-driving mode and the second-frequency-driving mode. Thus, the possibility of the sudden change of the brightness of the display device is reduced when the driving mode switches between the first-frequency-driving mode and the second-frequency-driving mode. Therefore, the brightness transition effect of the display device is improved when the driving mode switches between the two driving modes to improve the display effect of the display device.

Although some specific embodiments of the present disclosure are described in detail through examples, those of skill in the art should understand that the above examples are merely for description but do not limit the scope of the present disclosure. Those of skill in the art should understand that without departing the scope and spirit of the present disclosure, modifications may be made to the above embodiments. The scope of the present disclosure is defined by the claims.

What is claimed is:

1. A pixel driving circuit, comprising:
a first power signal terminal;
a second power signal terminal;
a drive transistor, wherein a gate of the drive transistor is connected to a first node, a first electrode of the drive transistor is connected to a second node, and a second electrode of the drive transistor is connected to a third node;
a light-emitting element, wherein a positive electrode of the light-emitting element is connected to a fourth node, and a negative electrode is connected to the second power signal terminal; and
a storage element, wherein a first terminal of the storage element is connected to a fixed potential, and a second terminal of the storage element is connected to the first node;
wherein:
in a same time frame of a display, a driving process using the pixel driving circuit includes a non-light-emitting phase and a light-emitting Phase;
the pixel driving circuit includes a first-frequency-driving mode at a first frequency, and a second-frequency-driving mode at a second frequency, and the first frequency is higher than the second frequency;
a signal received by the pixel driving circuit includes a first control signal; and
a relative pulse change amount of the first control signal from the non-light-emitting phase to the light-emitting phase in the first-frequency-driving mode is $\Delta V1$; a relative pulse change amount of the first control signal from the non-light-emitting phase the second-frequency-driving mode is $\Delta V2$; and $\Delta V2>\Delta V1$.

2. The pixel driving circuit of claim 1, wherein the first frequency is represented as f1, the second frequency is represented as f2, 30 Hz<f1<90 Hz, and f2≤30 Hz.

3. The pixel driving circuit of claim 1, wherein:
a light-emitting circuit is connected to a light-emitting control terminal through a light-emitting control line, the light-emitting control terminal receives a light-emitting control signal and transmits the light-emitting control sitgnal to the light-emitting control circuit through the light-emitting control line in the light-emitting phase, and the light-emitting control signal is used as the first control signal;
the light-emitting control signal includes a first level signal having a voltage value VGH1 and a second level signal having a voltage value VGL1 in the first-frequency-driving mode, VGH1>VGL1, and $\Delta V1=VGH1-VGH1$; and
the light-emitting control signal includes a third level signal having a voltage value VGH2 and a fourth level signal having a voltage value VGL2 in the second-frequency-driving mode, VGH2>VGL2, and ΔV2=VGL2−VGH2.

4. The pixel driving circuit of claim 3, wherein VGL2>VGL1 or VGH2<VGH1.

5. The pixel driving circuit of claim 3, wherein VGL1<VGL2≤1.3*VGL1 or 0.7*VGH1≤VGH2<VGH1.

6. The pixel driving circuit of claim 3, wherein;

the light-emitting control circuit includes a first transistor and a second transistor;

the light-emitting control line includes a first light-emitting control line and a second light-emitting control line;

a gate of the first transistor is connected to the light-emitting control terminal through the first light-emitting control line;

a gate of the second transistor is connected to the light-emitting control terminal through the second light-emitting control line;

a first electrode of the first transistor is connected to the first power signal terminal, and a second electrode of the first transistor is connected to the second node; and a first electrode of the second transistor is connected to the third node, and a second electrode of the second transistor is connected to the fourth node.

7. The pixel driving circuit of claim 1, further comprising a compensation circuit, wherein:

a first terminal of the compensation circuit is connected to the first node, a second terminal of the compensation circuit is connected to the third node, a control terminal of the compensation circuit is connected to a control signal terminal, the control signal terminal is configured to transmit a scan signal to the compensation circuit, and the scan signal is used as the first control signal;

the scan signal includes a first scan signal having a voltage value VH1 and a second scan signal having a voltage value VL1 in the first-frequency-driving mode, VH1>VL1, and ΔV1=VH1−VL1; and the scan signal includes a third scan signal having a voltage value VH2 and a fourth scan signal having a voltage value VL2 the second-frequency-driving mode, VH2>VL2, and ΔV2=VH2−VL2.

8. The pixel driving circuit of claim 7, wherein VL2<VL1 or VH2>VH1.

9. The pixel driving circuit claim 7, wherein 0.8*VL1≤VL2<VL1 or VH1≤VH2≤*VH1.

10. The pixel driving circuit of claim 7, wherein:

the compensation circuit includes a compensation transistor;

a first electrode of the compensation transistor is used as the first terminal of the compensation circuit;

a second electrode of the compensation transistor is used as the second terminal of the compensation circuit; and a gate of the compensation transistor is used as the control terminal of the compensation circuit.

11. A driving method of a pixel driving circuit, including a first power signal terminal, a second power signal terminal, a drive transistor, wherein a gate of the drive transistor is connected to a first node, a first electrode of the drive transistor is connected to a second node, and a second electrode of the drive transistor is connected to a third node, a light-emitting element, wherein a positive electrode of the light-emitting element is connected to a fourth node, and a negative electrode is connected to the second power signal terminal, and a storage element, wherein a first terminal of the storage element is connected to a fixed potential, and a second terminal of the storage element is connected to the first node, wherein in a same time frame of a display, a driving process using the pixel driving circuit includes a non-light-emitting phase and a light-emitting phase, the pixel driving circuit includes a first-frequency-driving mode at a first frequency, and a second-frequency-driving mode at a second frequency, and the first frequency is higher than the second frequency, a signal received by the pixel driving circuit includes a first control signal, and a relative pulse change amount of the first control signal from the non-light-emitting phase to the light-emitting phase in the first-frequency-driving mode is ΔV1; a relative pulse change amount of the first control signal from the non-light-emitting phase to the light-emitting phase in the second-frequency-driving mode is ΔV2 and ΔV2>ΔV1, comprising:

a non-light-emitting phase and a light-emitting phase in a same time frame of displaying;

a first-frequency-driving mode at a first frequency and a second-frequency-driving mode at a second frequency, wherein:

the first frequency is higher than the second frequency; and a relative pulse change amount of the first control signal from the non-light-emitting phase to the light-emitting phase in the first-frequency-driving mode is ΔV1; a relative pulse change amount of the first control signal from the non-light-emitting phase to the light-emitting phase in the second-frequency-driving mode is ΔV2; and ΔV2>ΔV1.

12. The driving method of claim 11, further comprising:

connecting a light-emitting control circuit to a light-emitting control terminal through a light-emitting control line;

receiving, a light-emitting control signal at the light-emitting control terminal;

transmitting the light-emitting control signal to a light-emitting circuit through the light-emitting control line; and using the light-emitting control signal as the first control signal, wherein in the first-frequency-driving mode:

the light-emitting control signal includes a first level signal having a voltage value VGH1 and a second level signal having a voltage value VGL1; the light-emitting control terminal transmits the first level signal to the light-emitting control circuit to control the light-emitting control circuit to turn off in the non-light-emitting phase, the light-emitting control terminal transmits the second level signal to the light-emitting control circuit to control the light-emitting control circuit to turn on in the light-emitting phase, VGH1>VGL1, and ΔV1=VGL1−VGH1; and wherein in the second-frequency-driving mode:

the light-emitting control signal includes a third level signal having a voltage value VGH2 and a fourth level signal having a voltage value VGL2, the light-emitting control terminal transmits the third level signal to the light-emitting control circuit, to control the light-emitting control circuit to turn off in the non-light-emitting phase, the light-emitting control terminal transmits the fourth level signal to the light-emitting control circuit to control the light-emitting control circuit to turn on in the light-emitting phase, VGH2>VGL2, and ΔV2=VGL2−VGH2.

13. The driving method of claim 11, wherein:

the pixel driving circuit includes a compensation circuit, a first terminal of the compensation circuit is connected to a first node, a second terminal is connected to a third node, a control terminal is connected to a control signal terminal, the control signal terminal is configured to transmit a scan signal to die compensation circuit, the scan signal is used as the first control signal; and the non-light-emitting phase includes a data writing phase;

wherein in the first-frequency-driving mode:

the scan signal includes a first scan signal having a voltage value VH1 and a second scan signal having a voltage value VL1, the first control signal terminal transmits the second scan signal to the compensation circuit to turn on the compensation circuit in the data writing phase, the first control signal terminal transmits the first scan signal to the compensation circuit to turn off the compensation circuit in the light-emitting phase, and ΔV1−VH1−VL1; and wherein in the second-frequency-driving mode:

the scan signal includes as third scan signal having a voltage value VH2 and a fourth scan sig al having a voltage value VL2, the first control signal terminal transmits the fourth scan signal to the compensation circuit to turn on the compensation circuit in the data writing phase the first control signal terminal t the third scan signal to the compensation circuit to turn off the compensation circuit in the light-emitting phase, and ΔV2=VH2−VL2.

14. A display device, comprising:

pixel driving circuit, including:

a first power signal terminal;

a second power signal terminal;

a drive transistor, wherein a gate of the drive transistor is connected to a first node, a first electrode of the drive transistor is connected to a second node, and a second electrode of the drive transistor is connected to a third t de;

a light-emitting element, wherein a positive electrode of the light-emit element is connected to a fourth node, and a negative electrode electrically is connected to the second power signal terminal; and as storage element, wherein a first terminal of the storage element is connected to a fixed potential, and a second terminal the storage element is connected to the first node;

wherein:

in a same time frame of a display, a drive process using the pixel driving circuit includes a non-light-emitting phase and a light-emitting phase;

the pixel driving circuit includes a first-frequency-driving mode at a first frequency and a second-frequency-driving mode at a second frequency, and the first frequency is higher than the second frequency;

a signal received by the pixel driving circuit includes a first control signal; and a relative pulse change amount of the first control signal from the non-light-emitting phase to the light-emitting phase in the first-frequency-driving mode is ΔV1; a relative pulse change amount of the first control signal from the non-light-emitting phase to the light-emitting phase in the second-frequency-driving mode is ΔV2; and ΔV2>ΔV1.

15. The display device of claim 14, wherein:

a light-emitting circuit is connected to a light-emitting control terminal through a light-emitting control line, the light-emitting control terminal receives a light-emitting control signal and transmits the light-emitting control signal to the light-emitting control circuit through the light-emitting control line in the light-emitting phase, and the light-emitting control signal is used as the first control signal;

the light-emitting control signal includes a first level signal having a voltage value of VGH1 and a second level signal having a voltage value of VGL1 in the first-frequency-driving mode, VGH1>VGL1, and ΔV1=VGL1−VGH1; and the light-emitting control signal includes a third level signal having a voltage value VGH2 and a fourth level signal having a voltage value VGL2 in the second-frequency-driving mode, VGH2>VGL2, and ΔV2=VGL2−VGH2.

16. The display device of claim 15, wherein:

the light-emitting control circuit includes a first transistor and a second transistor;

the light-emitting control line includes a first light-emitting control line, and a second light-emitting control line;

a gate of the first transistor is connected to the light-emitting control terminal through the first light-emitting control line;

a gate of the second transistor is connected to the light-emitting control terminal through the second light-emitting control line;

a first electrode of the first transistor is connected to the first power signal terminal, and a second electrode of the first transistor is connected to the second node; and a first electrode of the second transistor is connected to the third node, and a second electrode of the second transistor is connected to the fourth node.

17. The display device of claim 16, further comprising a compensation circuit, wherein:

a first terminal of the compensation circuit is connected to the first node, a second terminal of the compensation circuit is connected to the third node, and a control terminal of the compensation circuit is connected to a control signal terminal, the control signal terminal is configured to transmit a scan signal to the compensation circuit, and the scan signal is used as the first control signal;

the scan signal includes a first scan signal having a voltage value VH1 and a second scan signal having a voltage value VL1 in the first-frequency-driving mode, VH1>VH1, and ΔV1 VH1−VL1; and the scan signal includes a third scan signal having a voltage value VH2 and a fourth scan signal having a voltage value VL2 in the second-frequency-driving mode, VH2>VL2, and ΔV2=VH2−VL2.

18. The display device of claim 17, wherein:

the compensation circuit includes a compensation transistor;

a first electrode of the compensation transistor is used as the first terminal of the compensation circuit;

a second electrode of the compensation transistor is used as the second terminal of the compensation circuit; and a gate of the compensation transistor is used as the control terminal of the compensation circuit.

* * * * *